US010014623B2

(12) United States Patent
Ernest et al.

(10) Patent No.: US 10,014,623 B2
(45) Date of Patent: Jul. 3, 2018

(54) X-RAY TUBE HIGH VOLTAGE CONNECTOR WITH INTEGRATED HEATING TRANSFORMER

(71) Applicant: General Electric Company, Schenectady, NY (US)

(72) Inventors: Philippe Ernest, Gif/Yvette (FR); Stephane Gautrais, Jouy en Josas (FR); Yannick Louvrier, Bois D'Arcy (FR); Nicolas Levilly, Magny les Hameaux (FR)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 15/359,937

(22) Filed: Nov. 23, 2016

(65) Prior Publication Data

US 2018/0145444 A1 May 24, 2018

(51) Int. Cl.

| | |
|---|---|
| ***H01R 13/53*** | (2006.01) |
| ***H01F 30/02*** | (2006.01) |
| ***H01R 13/66*** | (2006.01) |
| ***H05G 1/20*** | (2006.01) |
| ***H05G 1/54*** | (2006.01) |
| ***H05G 1/52*** | (2006.01) |

(52) U.S. Cl.

CPC ..... *H01R 13/53* (2013.01); *H01F 30/02* (2013.01); *H01R 13/66* (2013.01); *H05G 1/20* (2013.01); *H05G 1/52* (2013.01); *H05G 1/54* (2013.01)

(58) Field of Classification Search

CPC ..... H01R 13/53; H01R 13/66; H01F 30/22

USPC ..... 439/502

See application file for complete search history.

(56) References Cited

U.S. PATENT DOCUMENTS

| | | | | | |
|---|---|---|---|---|---|
| 3,971,946 | A * | 7/1976 | Craig | A61B 6/4476 | 378/195 |
| 4,296,986 | A * | 10/1981 | Herrmann, Jr. | H01R 13/53 | 439/322 |
| 4,486,895 | A * | 12/1984 | Barrett | H05G 1/265 | 378/111 |
| 4,797,907 | A * | 1/1989 | Anderton | H05G 1/10 | 378/101 |
| 5,434,900 | A * | 7/1995 | Tanaka | A61B 6/56 | 378/15 |
| 5,580,266 | A * | 12/1996 | Shelly | H01R 13/53 | 439/281 |
| 6,452,102 | B1 * | 9/2002 | DeForest, Jr. | H01R 13/405 | 174/75 C |
| 6,641,421 | B1 * | 11/2003 | Leavitt | H01R 13/53 | 439/271 |
| 6,781,060 | B2 * | 8/2004 | Radley | G01N 23/12 | 174/84 R |
| 6,989,486 | B2 * | 1/2006 | Lovoi | A61N 5/1001 | 174/110 R |
| 7,203,280 | B2 * | 4/2007 | Anno | H05G 1/04 | 378/130 |
| 7,307,512 | B2 * | 12/2007 | Yaney | H04B 3/56 | 333/101 |
| 7,448,801 | B2 * | 11/2008 | Oettinger | H05G 1/06 | 378/102 |

(Continued)

*Primary Examiner* — Alexander Gilman
(74) *Attorney, Agent, or Firm* — Fletcher Yoder, P.C.

(57) ABSTRACT

A high voltage connector is provided. The high voltage connector includes multiple electrical conductors, and at least one autotransformer. The high voltage connector is configured to couple a high voltage cable to an X-ray tube.

19 Claims, 5 Drawing Sheets

(56) References Cited

U.S. PATENT DOCUMENTS

| | | | | |
|---|---|---|---|---|
| 7,448,802 | B2 * | 11/2008 | Oettinger | H05G 1/06 378/102 |
| 7,448,910 | B2 * | 11/2008 | Chun | H01R 13/7197 439/618 |
| 7,517,242 | B2 * | 4/2009 | Brodersen | H01J 35/165 439/488 |
| 7,522,704 | B2 * | 4/2009 | Sung | H05G 1/06 378/102 |
| 7,741,945 | B2 * | 6/2010 | Godbey | H01F 27/29 336/192 |
| 7,815,371 | B2 * | 10/2010 | Schulze-Ganzlin | A61B 6/14 378/101 |
| 2003/0021377 | A1 * | 1/2003 | Turner | G01N 23/223 378/102 |
| 2009/0036939 | A1 * | 2/2009 | Singh | H01F 17/043 607/5 |
| 2012/0208386 | A1 * | 8/2012 | Beuster | H01R 13/53 439/283 |
| 2015/0213994 | A1 * | 7/2015 | Berk | H05G 1/06 378/140 |
| 2015/0255203 | A1 * | 9/2015 | Herzer | C21D 8/1238 336/233 |

* cited by examiner

X-RAY TUBE HIGH VOLTAGE CONNECTOR WITH INTEGRATED HEATING TRANSFORMER

BACKGROUND

The subject matter disclosed herein relates to a high voltage cable that couples to an X-ray tube and, in particular, to an X-ray tube high voltage connector with integrated heating transformer(s).

A variety of diagnostic and other systems may utilize X-ray tubes as a source of radiation. In medical imaging systems, for example, X-ray tubes are used in projection X-ray systems, fluoroscopy systems, tomosynthesis systems, and computer tomography (CT) systems as a source of X-ray radiation. The radiation is emitted in response to control signals during examination or imaging sequences. The radiation traverses a subject of interest, such as a human patient, and a portion of the radiation impacts a detector or a photographic plate where the image data is collected. In conventional projection X-ray systems the photographic plate is then developed to produce an image which may be used by a radiologist or attending physician for diagnostic purposes. In digital X-ray systems a digital detector produces signals representative of the amount or intensity of radiation impacting discrete pixel regions of a detector surface. In CT systems a detector array, including a series of detector elements, produces similar signals through various positions as a gantry is displaced around a patient.

The X-ray tube is typically operated in cycles including periods in which high voltages are generated between certain components (e.g., when X-rays are generated), interleaved with periods in which lower voltages are being used (e.g., the X-ray tube is not generating X-ray radiation). As an example, in a typical configuration, a high voltage is generated between a cathode, which generates an electron beam, and a target anode, which is struck by the electron beam. The high voltage applied between cathode and anode serves to accelerate the electron beams towards the anode, and the electron bombardment results in the generation of X-rays. The X-ray tube may be bipolar (cathode at negative half high voltage in respect to ground and anode at positive half high voltage in respect to ground) or unipolar (cathode at negative full high voltage in respect to ground and anode at ground). The main high voltage (unipolar tube) or cathode high voltage (bipolar tube), the filament(s) voltage and the bias/focusing electrode(s) voltage(s) are provided to the X-ray tube by a high voltage cable coupled to a high voltage generator. In following, this cable is called for simplification purpose "the high voltage cable". The high voltage cable includes a high voltage tube connector that couples the high voltage cable to the X-ray tube. In certain imaging systems (e.g., vascular X-ray imaging system), the high voltage generator is a significant distance (often 30 meters) from the X-ray tube.

BRIEF DESCRIPTION

In one embodiment, a high voltage connector is provided. The high voltage connector includes multiple electrical conductors, and at least one autotransformer. The high voltage connector is configured to couple a high voltage cable to an X-ray tube.

In an additional embodiment, a high voltage cable is provided. The high voltage cable is configured to couple to and provide power to an X-ray tube. The high voltage cable includes a cable portion configured to couple to a high voltage source. The high voltage cable also includes a high voltage connector configured to couple the cable portion to the X-ray tube to provide a filament drive circuit to the X-ray tube and bias voltages to the X-ray tube to control an electron beam generated within the X-ray tube. At least one autotransformer is integrated within the high voltage connector.

In a further embodiment, a method to determine a location of an open circuit in an X-ray generation system is provided. The method includes operating a filament drive circuit by providing a filament driving current to an X-ray tube via a high voltage cable coupled to the X-ray tube via a high voltage connector. At least one autotransformer is integrated within the high voltage connector. The method also includes determining, via a controller, a presence of an additional current due to the at least one autotransformer in the filament drive circuit. The method further includes determining, via the controller, whether the location of the open circuit is in the X-ray tube or the high voltage cable based on whether the additional current is present in the filament drive circuit.

BRIEF DESCRIPTION OF THE DRAWINGS

These and other features, aspects, and advantages of the present subject matter will become better understood when the following detailed description is read with reference to the accompanying drawings in which like characters represent like parts throughout the drawings, wherein.

DETAILED DESCRIPTION

Figure 1A:
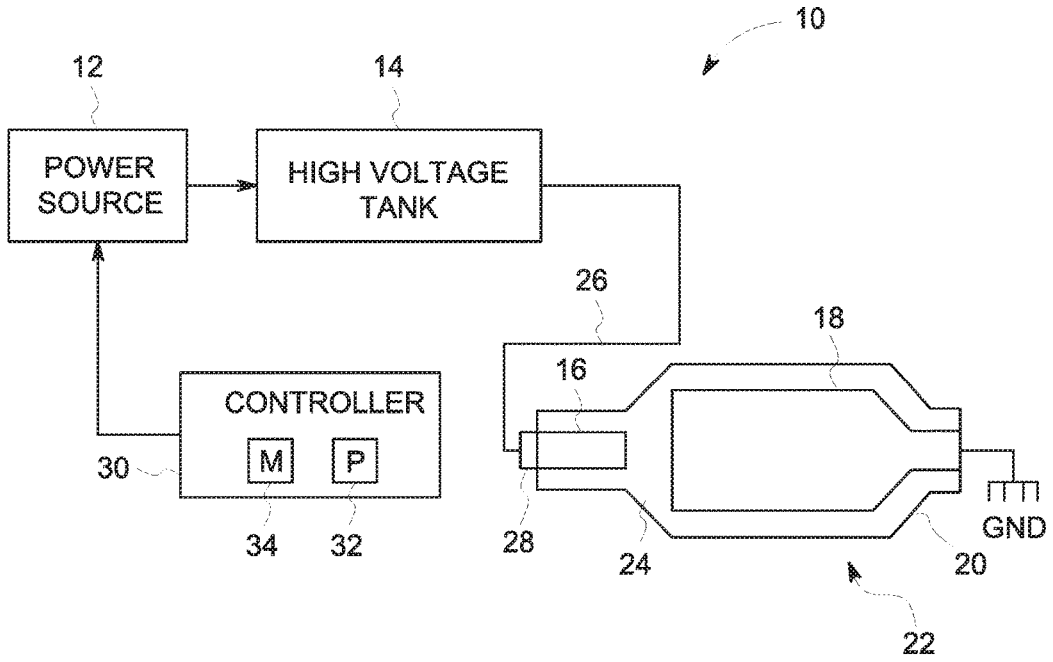
FIG. 1A depicts a schematic view of an embodiment of an unipolar X-ray generation system having a high voltage cable having a high voltage connector with an integrated transformer.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

As described herein, embodiments of a high voltage connector of a high voltage cable are provided that include one or more transformers (e.g., heating transformers) integrated within the high voltage connector. Integration of the transformers in the high voltage connector (as opposed to the X-ray tube unit) avoids any impact on the vacuum (e.g., due to materials degassing) within the X-ray tube and issues with temperature within the X-ray tube. In certain embodiments, the transformers within the high voltage connector are autotransformers or step down transformers. Autotransformers are small enough to fit within the high voltage connector, while being efficient enough to be compatible with connector thermal dissipation. In particular, the integrated autotransformers alters the filament impedance from the high voltage cable. The autotransformers improve efficiency by reducing current within the high voltage cable and increasing the voltage between filament conductors within the high voltage cable, while avoiding high voltage cable power losses (e.g., normally due to a decrease of current in the high voltage cable filament conductors). A respective autotransformer may be associated with a respective electrical conductor (associated within a respective filament of the X-ray tube) within the high voltage connector. In certain embodiments, the autotransformers include a step down ratio ranging from approximately 1:1 to 4:1. The higher the ratio, the less will be the current in the HV cable conductors, while increasing the voltage of the current source. In certain embodiments, the autotransformers each include a core (e.g., gapped material or non-gapped material such as iron powder or low μ nanocrystalline) having a low relative permeability, $\mu_r$ (e.g., ranging from approximately 200 to 3000 at 50 Hertz (Hz)) that enables a minimization of the size of the autotransformer and makes easier the open failure detection. In addition, the presence of the autotransformers within the high voltage connector enables a reduction in the size (e.g., diameter) of the high voltage cable, while increasing the flexibility of the high voltage cable. In certain imaging systems (e.g., vascular X-ray imaging system), the high voltage generator is a significant distance from the X-ray tube. Thus, the high voltage cable needs to be long enough to enable a change in position of the X-ray tube during the imaging procedure. A high voltage cable with greater flexibility and a smaller diameter, due to the autotransformers integrated within the high voltage connectors, enables greater movement of the X-ray tube.

Figure 1B:
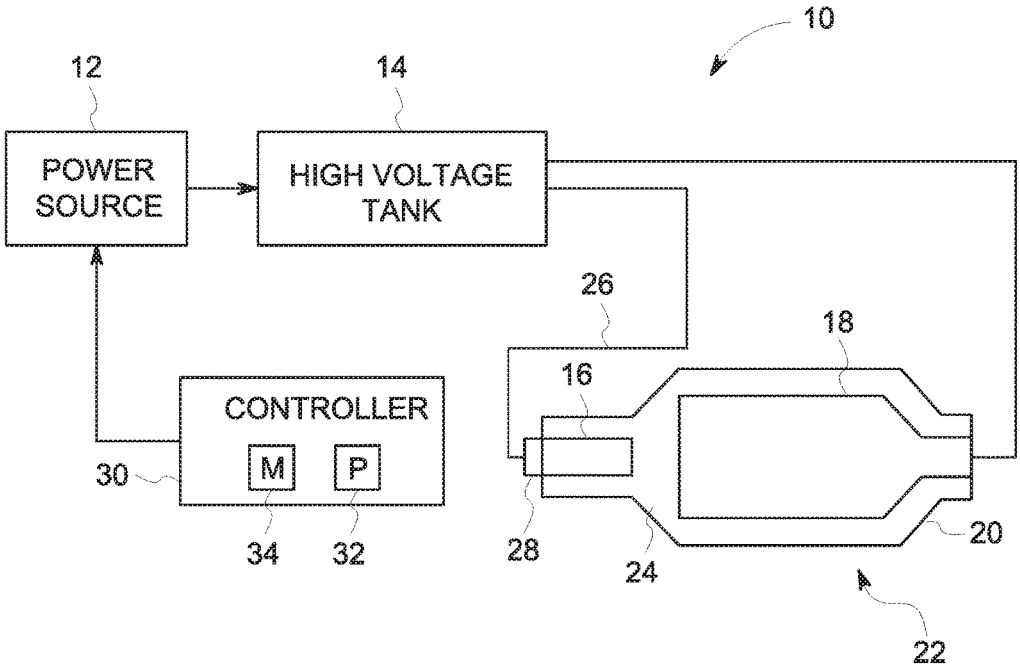
FIG. 1B depicts a schematic view of an embodiment of a bipolar X-ray generation system.

Turning to the drawings, FIGS. 1A and 1B illustrate a schematic diagram of an embodiment of X-ray generation system 10. FIG. 1A illustrates an unipolar X-ray generation system 10 and FIG. 1B illustrates a bipolar X-ray generation system 10. The X-ray generation system 10 may be utilized in a variety of different X-ray systems. For example, the X-ray generation system may be utilized in projection X-ray systems, fluoroscopy systems, tomosynthesis systems, and computer tomography (CT) systems. The X-ray generation system 10 includes a power source 12 coupled to and providing power to a high voltage tank 14. The high voltage tank 14 is coupled to and provides a high voltage potential difference between a cathode assembly 16 and an anode assembly 18 in an X-ray tube vacuum housing 20 of an X-ray tube 22. The cathode assembly 16 is located opposite the anode assembly 18 within the X-ray tube vacuum housing 20, and the cathode assembly 16 and anode assembly 18 are separated by a vacuum gap 24 located there between. The high voltage tank 14 is coupled to the X-ray tube 22 via a high voltage cable 26. The high voltage cable 26 is coupled to the cathode assembly 16 via a high voltage connector 28. In certain embodiments, the high voltage connector 28 is integral to the high voltage cable 26. In other embodiments, the high voltage connector 28 is separable from the high voltage cable 26. The high voltage connector 28 includes a plurality of electrical components. As described in greater detail below, the high voltage connector 28 includes one or more transformers (heating transformers) integrated within the high voltage connector 28. In certain embodiments, the transformers may include autotransformers or step down transformers. A respective autotransformer may be associated with a respective electrical conductor (associated within a respective filament of the X-ray tube 22) within the high voltage connector 28.

The power source 12 is an AC power source that provides AC power to the high voltage generator 14. The high voltage tank 14 is designed to receive AC power from the power source 12 and provide (via the high voltage cable 26) a DC high voltage potential difference between the cathode assembly 16 and anode assembly 18 within the X-ray tube housing 20 where the cathode assembly 16 and anode assembly 18 carry equal voltages of different polarity. The high voltage tank 14 also provides a filament drive current (e.g., via a filament drive circuit) for one or more electron-emitting filaments within the cathode assembly 16 and/or bias voltages for controlling an electron beam from the cathode assembly 16 to the anode assembly 18.

The cathode assembly 16 includes one or more electron-emitting filament that is capable of emitting electrons. In order to generate the X-rays, the high voltage tank 14 provides power to a filament drive circuit that generates a current through the one or more filaments in the cathode assembly 16. The one or more filaments is heated to incandescence and releases electrons. The electrons are accelerated across the vacuum gap 24 by the high voltage potential difference between the cathode assembly 16 and anode assembly 18 in an electron beam and strike a target track on the anode assembly 18 producing X-rays.

As depicted in FIG. 1, one or more components of the X-ray generation system 10 may be coupled to a controller/control circuitry (e.g., X-ray controller) 30. The controller 30 may control aspects of the X-ray generation system 10. For example, the controller 30 may provide power and timing signals to the X-ray generation system 10. In certain embodiments, the controller 30 may monitor the filament drive circuit (e.g., to detect an open failure such as an open circuit or open contact). It can be difficult to distinguish the capacitance current in the filament drive circuitry due to the long and thin cable from the magnetizing current of the transformers within the high voltage connector 28. In one embodiment, permeability of the core can be lowered to increase the transformer magnetizing current. In another embodiment, the resonant frequency can be utilized to distinguish between a normal condition, an open filament, or an open cable. In all three cases, a very distinct resonant frequency is produced. More specifically, the controller 30, during an open failure (e.g., open circuit or open contact) may monitor the filament drive circuit for the presence of an additional current (e.g., small magnetizing current) due to the one or more transformers. In certain embodiments, the magnetizing current has a distinct resonant frequency indicating the condition as noted above. Determining the absence or presence of the additional current enables the controller to determine the location of the open failure (e.g., in the high voltage cable 26 or the X-ray tube 22). The controller 30 includes processing circuitry (e.g., processor 32) and memory circuitry (e.g., memory 34). The processor 32 may include multiple microprocessors, one or more "general-purpose" microprocessors, one or more special-purpose microprocessors, and/or system-on-chip (SoC) device, or some other processor configuration. In certain embodiments, as an alternative to a processor, one or more application specific integrated circuits (ASICS) may be utilized. For example, the processor 32 may include one or more reduced instruction set (RISC) processors or complex instruction set (CISC) processors. The processor 32 may execute instructions to carry out the operation of the X-ray generation system 10. These instructions may be encoded in programs or code stored in a tangible non-transitory computer-readable medium (e.g., an optical disc, solid state device, chip, firmware, etc.) such as the memory 34. In certain embodiments, the memory 34 may be wholly or partially removable from the controller 30.

Figure 2:
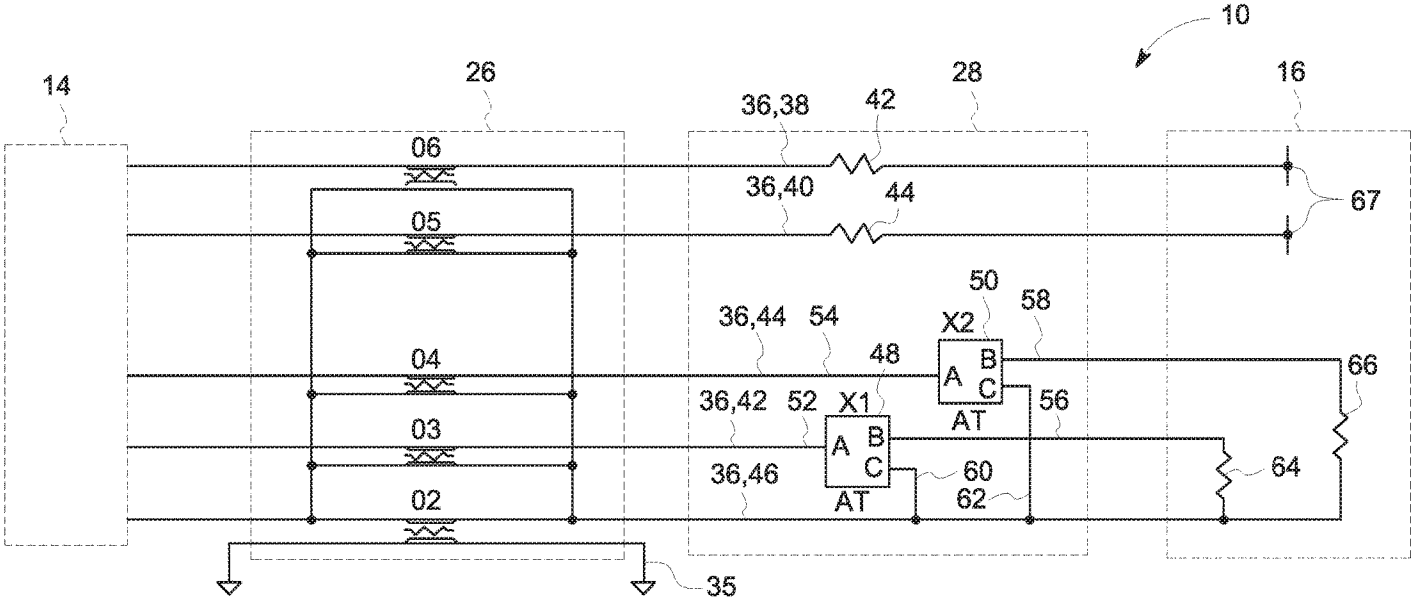
FIG. 2 depicts a detailed schematic view of a portion of the X-ray generation system of FIGS. 1A and 1B.

FIG. 2 depicts a detailed schematic view of a portion of the X-ray generation system 10 of FIG. 1. In particular, FIG. 2 depicts the electrical coupling of the high voltage tank 14, the high voltage cable 26 and its high voltage connector 28, and the cathode assembly 16 of the X-ray tube 22. As depicted, the high voltage cable 26 includes coaxial cables O2 thru O6 of the high voltage cable 26. The high voltage cable includes a grounded shield 35. The high voltage cable 26 and the high voltage connector 28 include a plurality of conductors (e.g., electrical conductors) 36 that electrically interact with the cathode assembly 16. As depicted, the plurality of conductors 36 includes at least one conductor 38 for providing a bias voltage to control electron beam focal spot length and at least one conductor 40 for providing a bias voltage to control electron beam focal spot width via bias electrodes 67 within the cathode assembly 16. Conductors 38, 40 each include a respective resistor 42, 44 disposed within the high voltage connector 28. In certain embodiments, the high voltage cable 26 and the high voltage connector 28 may include additional conductors to provide biasing voltages to control the electron beam (e.g., for focusing, focal spot wobbling, etc.). In certain embodiments, the high voltage cable 26 and the high voltage connector 28 may not include any conductors for provide a biasing voltage.

As depicted, the cathode assembly 16 includes two filaments for emitting electrons. In certain embodiments, the number of filaments within the cathode assembly 16 may vary (e.g., 1, 2, 3, 4, etc.). As depicted, the plurality of conductors 36 includes a first conductor 42 (e.g., filament conductor) for providing filament drive current to a first filament within the cathode assembly 16 and a second conductor 44 (e.g., filament conductor) for providing filament drive current to a second filament within the cathode assembly 16. The number of conductors for providing filament drive current may vary (e.g., 1, 2, 3, 4, etc.) based on the number of filaments in the cathode assembly 16. The plurality of conductors 36 also include a high voltage common return conductor 46.

As depicted, each filament conductor 42, 44 is coupled to a respective transformer or heating transformer 48 (X1), 50 (X2) disposed or integrated within the high voltage connector 28. Each transformer 48, 50 is a small transformer such as a step down transformer or autotransformer. The transformers 48, 50 do not have high voltage insulation functionality from ground to high voltage. The size of the autotransformers 48, 50 enables them to be disposed within the high voltage connector 28. In certain embodiments, the autotransformers 48, 50 include a step down ratio ranging from approximately 1.5:1 to 4:1. For example, in certain embodiments, the autotransformers 48, 50 include a step down ratio of 2:1.

In certain embodiments, the autotransformers 48, 50 each include a nanocrystalline core having a low relative permeability, $\mu_r$, (e.g., ranging from approximately 200 to 3000 at 50 Hertz (Hz)) that enables a minimization of the size of the autotransformer 48, 50, while accounting for permeability, saturation induction, and transformer losses. For example, the nanocrystalline core may include a low permeability, $\mu$, of 1000 at 50 Hz. The low permeability makes the nanocrystalline core appropriate for earth leakage circuit breaker usage and accommodation of high direct current induction, $B_{DC}$. Also, the nanocrystalline core provides a high maximum value of flux density ($B_{SAT}$).

In addition, the presence of the autotransformers 48, 50 within the high voltage connector 28 enables a reduction in the size (e.g., diameter) of the high voltage cable 26, while increasing the flexibility of the high voltage cable 26. In certain imaging systems (e.g., vascular X-ray imaging system), the high voltage tank 14 is a significant distance from the X-ray tube 22. Thus, the high voltage cable 26 needs to be long enough to enable a change in position of the X-ray tube 22 during the imaging procedure. A high voltage cable 26 with greater flexibility and a smaller diameter, due to the autotransformers 48, 50 integrated within the high voltage connector 28, enables the greater movement of the X-ray tube 22.

As depicted, each autotransformer 48, 50 includes three tapping points A, B, and C. Tapping point A of the autotransformers 48, 50 electrically couples, respectively, to upstream portions 52, 54 of the filament conductors 42, 44, while tapping point B electrically couples, respectively, to downstream portions 56, 58 of the filament conductors 42, 44. Tapping point C of the autotransformers 48, 50 is electrically coupled to the high voltage common return conductor 46 as indicated by conductors 60, 62, respectively. The downstream portions 56, 58 are electrically coupled, respectively, to the first and second filaments in the cathode assembly 16. As depicted, the electrical conductors 42, 44 include a resistor 64, 66, respectively, within the cathode assembly 16. In addition, the electrical conductors 42, 44 electrically couple to the high voltage common return conductor 46 within the cathode assembly 16.

Figure 3:
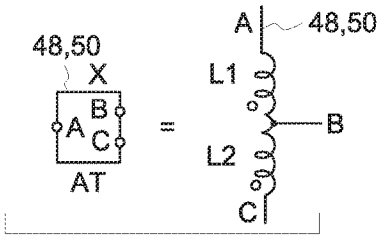
FIG. 3 depicts a diagrammatic view of an embodiment of an autotransformer in FIG. 2.

FIG. 3 depicts a diagrammatic view of an embodiment of the autotransformers 48, 50 in FIG. 2. The autotransformers 48, 50 include the tapping points A, B, and C as described above. Each autotransformer 48, 50 includes coil L1 (e.g., input winding) which is inductively coupled to coil L2 (e.g., output winding). Coil L1 includes tap A which couples to the upstream portions 52, 54 of the electrical conductors 42, 44, while coil L2 couples to the high voltage common return conductor 46. Tap B is located in an intermediate region between coils L1 and L2. The interleaved winding of the primary and secondary windings, in addition to ring shape, both increase the coupling factor and minimize magnetic leakage to create eddy currents. Thus, in certain embodiments, the coils L1 and L2 may be made of copper. In certain embodiments, coils L1 and L2 may each include 20 turns. As noted above, the autotransformers may each include a nanocrystalline core (see reference numeral 55 in FIGS. 4 and 5).

Figure 4:
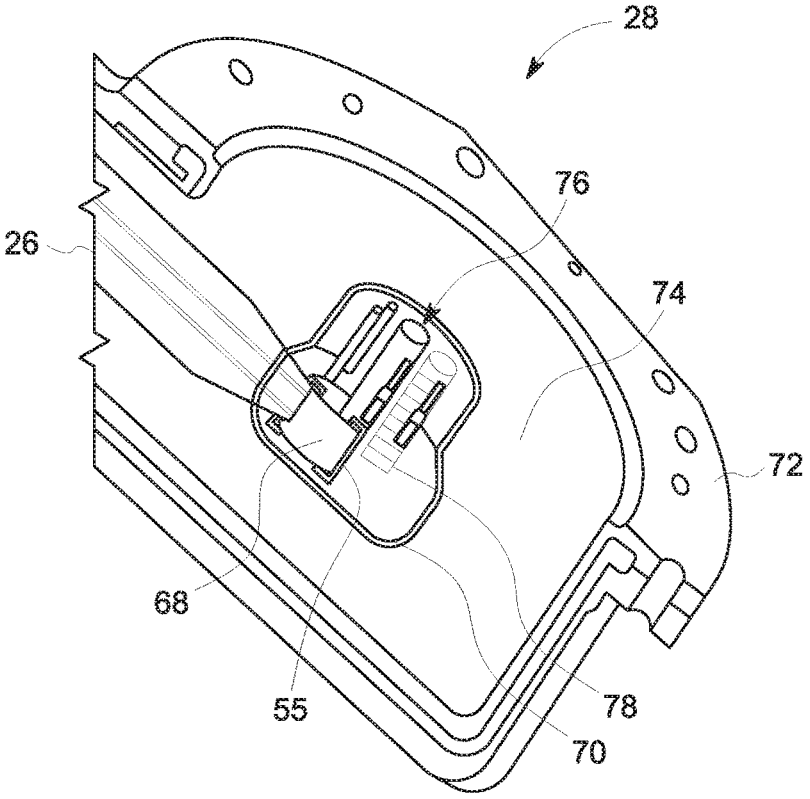
FIG. 4 depicts a perspective cross-sectional view of an embodiment of a high voltage connector having an integrated transformer.
Figure 5:
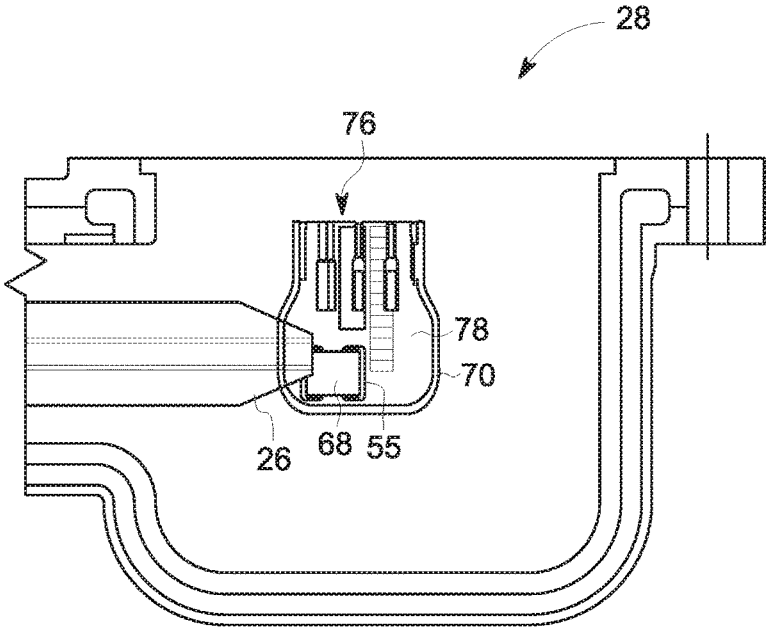
FIG. 5 depicts a portion of the high voltage connector, taken within line 5-5 of FIG. 4.

FIGS. 4 and 5 depict cross-sectional views of an embodiment of the high voltage connector 28 having an integrated transformer 68. As depicted, the high voltage connector 28 includes a body 70 disposed within a connector body 72 (e.g., metal conductive cup such as a Faraday cup). High voltage insulation material 74 (polymers, polyethylene, etc.) is disposed between the body 70 and the connector body 72. The body 70 is coupled to the high voltage cable 26. The high voltage cable 26 is as described above. The transformer 68 (e.g., autotransformer as described above) is disposed, along with other electrical components 76 (electrical conductors, resistors, varistors, overvoltage protection devices, etc.), within an insulating material (e.g., epoxy) mold 78 within the body 70. As noted above, the transformer 68 does not have high voltage insulation functionality from ground to high voltage. The transformer 68 is as described above. As depicted, the high voltage connector 28 includes a single transformer 68. In other embodiments, the high voltage connector 28 may include more than one transformer 68.

Figure 6:
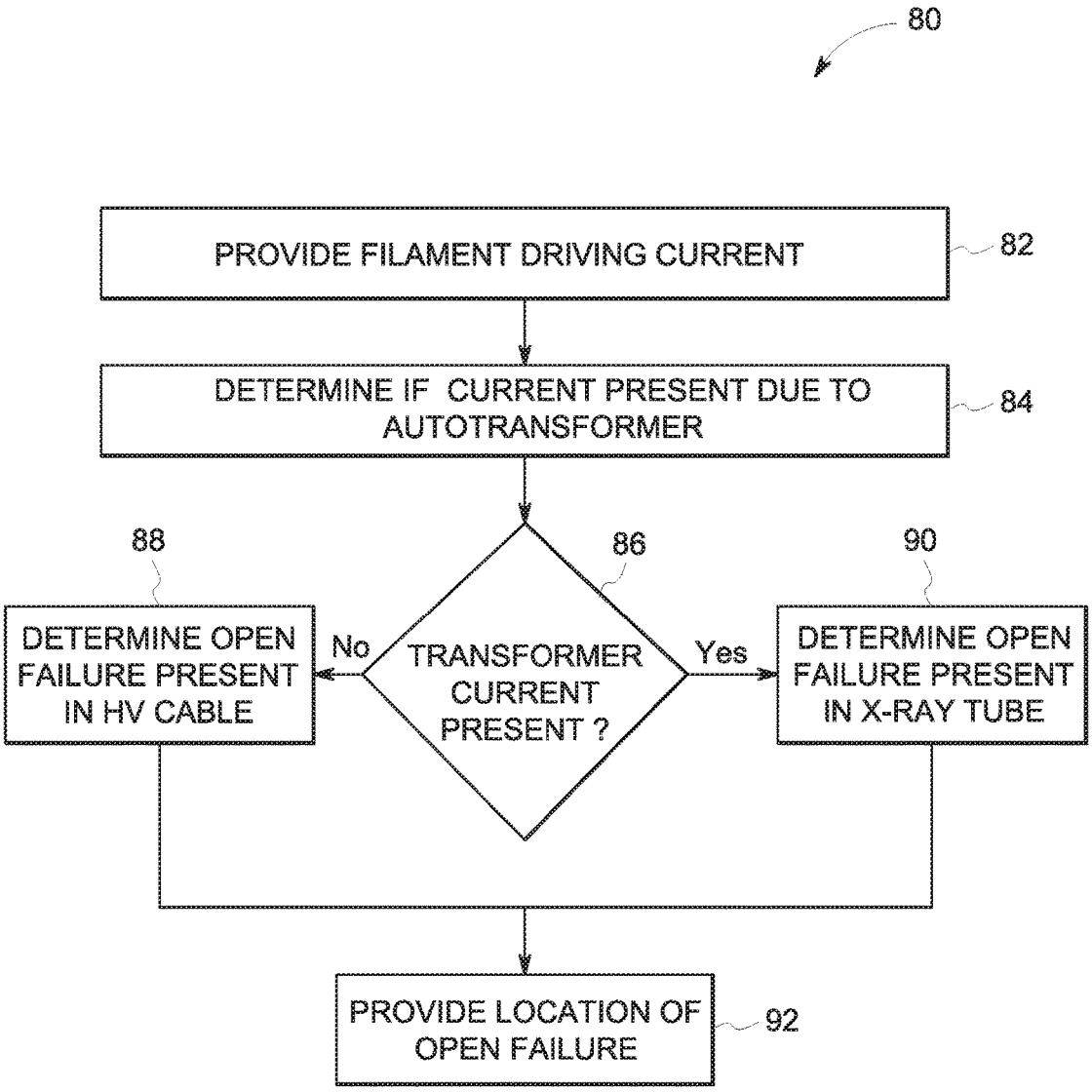
FIG. 6 depicts a flow chart of a method for determining a location of an open failure in an X-ray generation system.

In certain embodiments, the presence of the one or more transformers 68 within the high voltage connector 28 enables the X-ray generation system 10 to determine a location of an open failure (e.g., open circuit or open contact) within the system 10 (e.g., in the high voltage cable 26 up to the high voltage connector or within the X-ray tube 22. FIG. 6 depicts a flow chart of a method 80 for determining a location of an open failure in the X-ray generation system 10. One or more of the steps of the method 80 may be performed by the controller 30 or another component of an imaging system utilizing the X-ray generation system. In addition, one or more steps of the method 80 may be performed in different order or simultaneously. The method 80 includes operating a filament drive circuit by providing a filament drive current to cathode assembly 16 of the X-ray tube 22 (as described above) via the high voltage cable 16 coupled to the X-ray tube 22 via the high voltage connector 28 (block 82). The high voltage connector 28 includes one or more transformers 68 (e.g., autotransformers) integrated within. The method 80 also includes determining if an additional current (e.g., small magnetizing current generated by the transformers 68) is present within the filament drive circuit (block 84). In certain embodiments, if the open failure is within the high voltage cable 26, a smaller current flows form the filament drive circuit into the high voltage parasitic capacitance (e.g., corresponding to the cable length up to the point where it is open). The filament drive circuit is resonant. Lowering the frequency along the circuit will generate a nominal current at a frequency close to the resonance with the magnetizing inductance of the one or more transformers 68. Thus, if the open failure is within the X-ray tube 22, a larger current is present that includes the additional current from the one or more transformers 68. Thus, the method 80 determines whether the additional current is present (block 86). If the additional current is absent, the method 80 includes determining that open failure is located within the high voltage cable 26 (block 88). If the additional current is present, the method 80 includes determining that the open failure is located within the X-ray tube 22 (block 90). Upon determining the location of the open failure, a control action may be performed such as providing a location of the open failure (block 92) and/or a recommendation (e.g., replace high voltage cable 26, replace X-ray tube 22, etc.) via an output device.

Technical effects of the disclosed embodiments include providing a high voltage cable that include a high voltage connector with an integrated transformers (e.g., heating transformers). The integration of the transformers within the high voltage connector enables a high voltage cable with a smaller diameter and greater flexibility. In addition, the integration of the transformers provides a high voltage with greater efficiency. For example, the high voltage cable can provide a higher voltage with a lesser current (compared to a larger high voltage cable), while minimizing power losses.

This written description uses examples to disclose the subject matter, including the best mode, and also to enable any person skilled in the art to practice the subject matter, including making and using any devices or systems and performing any incorporated methods. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A high voltage connector, comprising:

a plurality of electrical conductors; and at least one autotransformer integrated within the high voltage connector, wherein the at least one autotransformer comprises a single winding comprising a primary winding coupled to a secondary winding;

wherein the high voltage connector is configured to couple a high voltage cable to an X-ray tube.

2. The high voltage connector of claim 1, wherein the at least one autotransformer comprises a step down ratio ranging from approximately 1 to 4.

3. The high voltage connector of claim 2, wherein the at least one autotransformer comprises a step down ratio of approximately 2.

4. The high voltage connector of claim 1, wherein the at least one autotransformer comprises a low relative permeability core having a relative permeability, $\mu_r$, at 50 Hertz ranging from approximately 200 to 3000.

5. The high voltage connector of claim 1, wherein the at least one autotransformer is disposed within an insulating material mold within a body.

6. The high voltage connector of claim 1, comprising a plurality of autotransformers disposed within a body, wherein the plurality of electrical conductors comprises a plurality of electrical conductors configured to provide a filament drive current to the X-ray tube, and each electrical conductor is configured to provide the filament drive current to the X-ray tube is associated with a respective autotransformer of the plurality of autotransformers.

7. The high voltage connector of claim 1, wherein the plurality of electrical conductors comprises at least one electrical conductor configured to provide a first biasing voltage to the X-ray tube to control an electron beam focal spot width, at least one electrical conductor configured to provide a second biasing voltage to the X-ray tube to control an electron beam focal spot length, at least two electrical conductors configured to provide a filament driving current to the X-ray tube, and at least one electrical conductor configured to provide a high voltage common return.

8. The high voltage connector of claim 7, comprising at least two autotransformers disposed within a body and associated with the at least two electrical conductors configured to provide the filament driving current to the X-ray tube.

9. The high voltage connector of claim 1, wherein the at least one autotransformer is configured to provide a magnetizing current to a filament driving current provided by at least one electrical conductor within the high voltage connector in the absence of an open wire within the high voltage cable.

10. A high voltage cable configured to couple to and provide power to an X-ray tube, comprising:

a cable portion configured to couple to a high voltage source; and a high voltage connector configured to couple the cable portion to the X-ray tube to provide a filament drive current to the X-ray tube and bias voltages to the X-ray tube to control an electron beam generated within the X-ray tube, wherein at least one autotransformer is integrated within the high voltage connector, and the at least one autotransformer comprises a single winding comprising a primary winding coupled to a secondary winding.

11. The high voltage cable of claim 10, wherein the high voltage connector comprises a body, a plurality of electrical conductors disposed within the body, and the at least one autotransformer is disposed within the body.

12. The high voltage cable of claim 11, wherein the at least one autotransformer is disposed within an insulating material mold within the body.

13. The high voltage cable of claim 10, wherein the at least one autotransformer comprises a step down ratio ranging from approximately 1:1 to 4:1.

14. The high voltage cable of claim 13, wherein the at least one autotransformer comprises a step down ratio of approximately 2:1.

15. The high voltage cable of claim 10, wherein the at least one autotransformer comprises a low relative permeability core having a relative permeability, $\mu_r$, at 50 Hertz ranging from approximately 200 to 3000.

16. The high voltage cable of claim 10, wherein the high voltage cable comprises a plurality of autotransformers disposed within the high voltage connector, wherein the plurality of electrical conductors comprises a plurality of electrical conductors configured to provide a filament drive current to the X-ray tube, and each electrical conductor is configured to provide the filament drive current to the X-ray tube is associated with a respective autotransformer of the plurality of autotransformers.

17. The high voltage cable of claim 10, wherein the plurality of electrical conductors comprises at least one electrical conductor configured to provide a first biasing voltage to the X-ray tube to control an electron beam focal spot width, at least one electrical conductor configured to provide a second biasing voltage to the X-ray tube to control an electron beam focal spot length, at least two electrical conductors configured to provide a filament driving current to the X-ray tube, and at least one electrical conductor configured to provide a high voltage common return.

18. The high voltage cable of claim 17, comprising at least two autotransformers disposed within the high voltage connector and associated with the at least two electrical conductors configured to provide the filament driving current to the X-ray tube.

19. The high voltage cable of claim 10, wherein the at least one autotransformer is configured to provide a magnetizing current to a filament driving current provided by at least one electrical conductor within the high voltage connector in the absence of an open wire within the high voltage cable.

* * * * *